United States Patent [19]

Elter

[11] Patent Number: 4,825,242

[45] Date of Patent: Apr. 25, 1989

[54] FUSING APPARATUS CONTROL SYSTEM

[75] Inventor: Michael R. Elter, Webster, N.Y.

[73] Assignee: Xerox Corporation, Stamford, Conn.

[21] Appl. No.: 173,891

[22] Filed: Mar. 28, 1988

[51] Int. Cl.[4] ..... G03G 15/20

[52] U.S. Cl. ..... 355/14 FU; 355/3 FU; 219/216

[58] Field of Search ..... 355/14 FU, 3 FU, 14 SH, 355/3 SH, 14 CU; 219/216, 482–486, 490; 432/60

[56] References Cited

U.S. PATENT DOCUMENTS

| | | | |
|---|---|---|---|
| 4,303,334 | 12/1981 | Haupt et al. | 355/14 FU |
| 4,429,990 | 2/1984 | Tamary | 355/14 FU |
| 4,551,007 | 1/1985 | Elter | 355/14 FU |
| 4,585,325 | 4/1986 | Euler | 355/14 FU |
| 4,588,281 | 5/1986 | Elter | 355/3 FU |
| 4,673,283 | 6/1987 | Hisajima et al. | 355/14 SH |

FOREIGN PATENT DOCUMENTS

| | | | |
|---|---|---|---|
| 57-201273 | 12/1982 | Japan | 355/14 FU |
| 61-95379 | 5/1986 | Japan | 355/14 FU |
| 61-126585 | 6/1986 | Japan | 355/14 FU |
| 61-201284 | 9/1986 | Japan | 355/14 FU |

*Primary Examiner*—R. L. Moses

*Attorney, Agent, or Firm*—H. Fleischer; J. E. Beck; R. Zibelli

[57] ABSTRACT

An apparatus in which an image is fused to a sheet during a copy run. The number of sheets having images fused thereto is counted during the copy run. Heat is applied to at least the images of successive sheets of the copy run. The heat being applied to the images on successive sheets is controlled in response to the number of sheets counted.

30 Claims, 5 Drawing Sheets

FUSING APPARATUS CONTROL SYSTEM

This invention relates generally to a fuser used in an electrophotographic printing machine, and more particularly concerns a system for controlling the fuser to provide a substantially uniform temperature distribution thereacross during the fusing of various size copy sheets.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive surface. After the electrostatic latent image is recorded on the photoconductive surface, the latent image is developed by bringing a developer mixture into contact therewith. A common type of developer comprises carrier granules having toner particles adhering triboelectrically thereto. This two-component mixture is brought into contact with the photoconductive surface. The toner particles are attracted from the carrier granules to the latent image. This forms a toner powder image on the photoconductive surface which is subsequently transferred to a copy sheet. Finally, the toner powder image is heated to permanently fuse it to the copy sheet in image configuration.

A high speed commercial printing machine of this type uses a fuser having a heated roll and a back-up roll pressed thereagainst. The copy sheet passes through the nip defined by the heated roll and back-up roll to heat the toner powder image and fuse it to the copy sheet. Typically, the heated roll is centrally heated. While most centrally heated rolls use a single internal heat lamp, some fusers have two internal heat lamps. Two internal heat lamps are generally required when there is a large variation in the size of the copy sheets being handled. In this type of fuser, the main heat lamp is typically used to maintain the roll surface at the appropriate temperature during standby with the other heat lamp being used to maintain the heat roll at the appropriate temperature to fuse the toner powder image to the smaller size copy sheets. Although the purpose of using two heat lamps is to minimize temperature variations that are experienced when the copy sheets vary greatly in size, excessive gradients still occur. The main heat lamp extends across the length of the largest copy sheet to provide enough energy to fuse a toner powder image thereon. However, when a smaller copy sheet is being used, a thermal hump is produced outside the length of the smaller sheet. Thereafter, when the larger copy sheet is used, there is a temperature variation along the length of the roll which degradates copy quality. Various approaches have been devised to control the temperature variations along the length of a fuser roll, the following disclosures appear to be relevant:

US-A-4,551,007
Patentee: Elter
Issued: November 5, 1985
US-A-4,585,325
Patentee: Euler
Issued: April 29, 1986
US-A-4,588,281
Patentee: Elter -continued Issued: May 13, 1986
US-A-4,673,283
Patentee: Hisajima et al.
Issued: June 16, 1987

The relevant portions of the foregoing disclosures may be briefly summarized as follows:

U.S. Pat. No. 4,551,007 discloses a controller which utilizes time derivatives of a sensor measuring the surface temperature of a fuser roll to control the output energy from a fuser heat lamp.

U.S. Pat. No. 4,585,325 describes a heated fixing roller having two heating elements located inside the roller. The heating elements are connected to a control system and a sensor to control the current being supplied to the heating elements.

U.S. Pat. No. 4,588,281 discloses a fuser roll having a heat lamp disposed interiorly thereof. The heating filament of the heat lamp extends along the longitudinal axis of the fuser roll and is asymmetrical with respect to a reference axis extending through the center of the fuser roller and normal to the longitudinal axis thereof.

U.S. Pat. No. 4,673,283 describes a copying machine having a fixed standstill time when larger size copy sheets are being used to achieve good heating and fusing of the image.

In accordance with one aspect of the present invention, there is provided an apparatus for fusing an image to a sheet during a copy run. The apparatus includes means for counting the number of sheets having images fused thereto during the copy run. Means are provided for applying heat to at least the images on successive sheets of the copy run. Means, responsive to the number of sheets counted by the counting means, control the heat applying means.

Pursuant to another aspect of the present invention, there is provided an electrophotographic printing machine of the type having a fusing apparatus for fusing a toner powder image transferred to a copy sheet during a copy run of the printing machine. The improved fusing apparatus includes means for counting the number of copy sheets having toner powder images fused thereto during the copy run. Means are provided for applying heat to at least the toner powder images on successive copy sheets of the copy run. Means, responsive to the number of copy sheets counted by the counting means, control the heat applying means.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
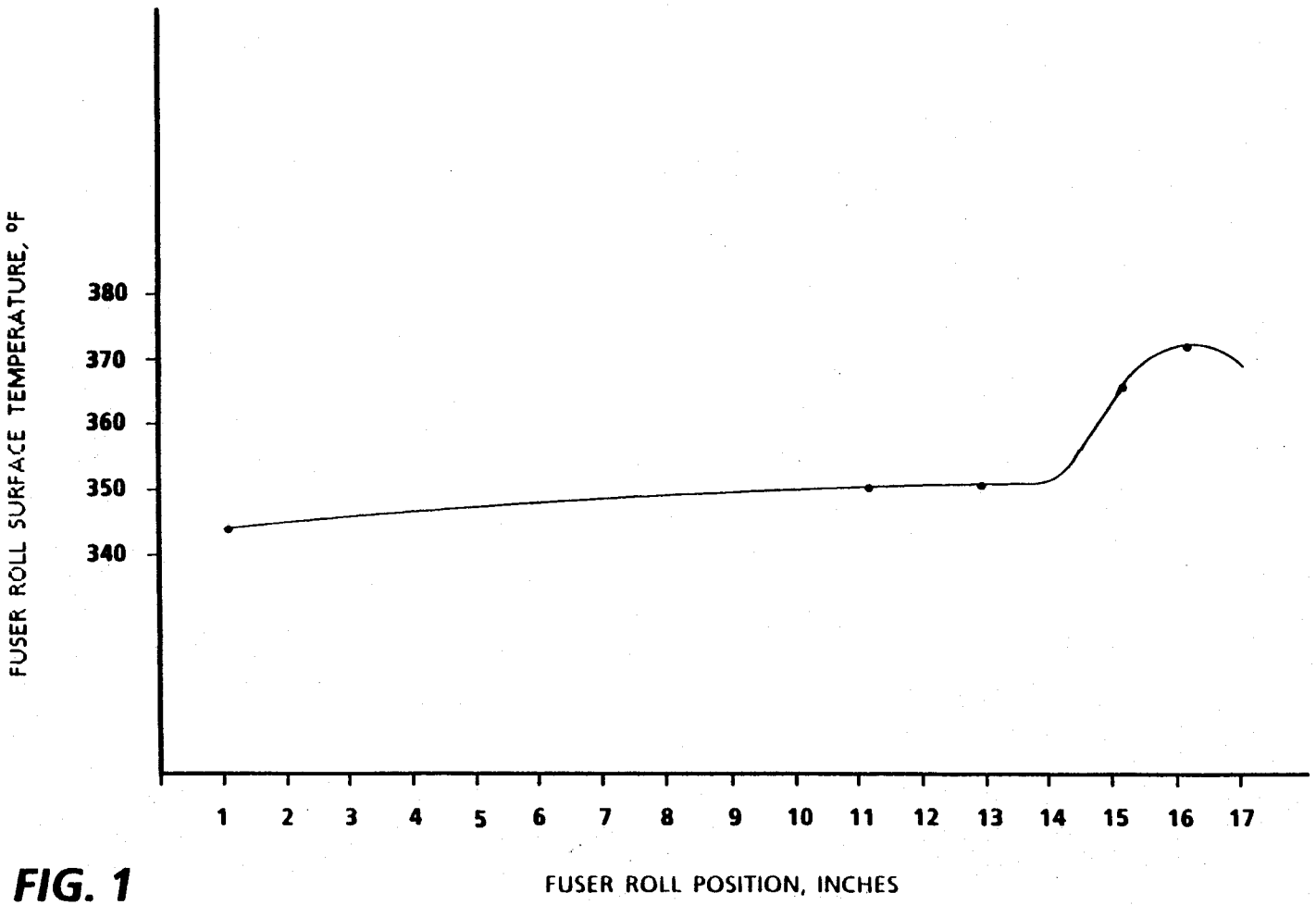
FIG. 1 is a graph showing the temperature variation of the fuser roll surface when the control scheme of the present invention is not used.

Referring initially to FIG. 1, there is shown a graph illustrating the temperature variation across the surface of the fuser roller when the control scheme of the present invention is not used. Since the main heat lamp must provide sufficient energy to fuse an image on a 11 inch by 16.5 inch copy sheet, the filament in this lamp must extend the entire length of the sheet which passes through the fuser. In the case of a printing machine that is capable of handling sheets long edge feed, this distance is approximately 16.5 inches. The main heat lamp is also used for 14 inch sheets. The temperature profile across the surface of the fuser roller shown in FIG. 1 develops when a 14 inch sheet is used. As shown, there is a temperature rise of approximately 25° F. beyond the 14 inch length of sheet. This temperature jump represents a high thermal stress at the 14 inch edge which may cause hot offsetting of the toner particles. If, after a 14 inch sheet is used, a 16.5 inch sheet is used, this thermal hump may cause uneven fusing across the 16.5 inch sheet. Thus, it is clear that it is highly desirable to have a substantially constant temperature profile across the surface of the fuser roll without a temperature rise of the type shown in FIG. 1.

Inasmuch as the art of electrophotographic printing is well known, the various processing stations employed in the FIG. 2 printing machine will be shown hereinafter schematically and their operation described briefly with reference thereto.

Figure 2:
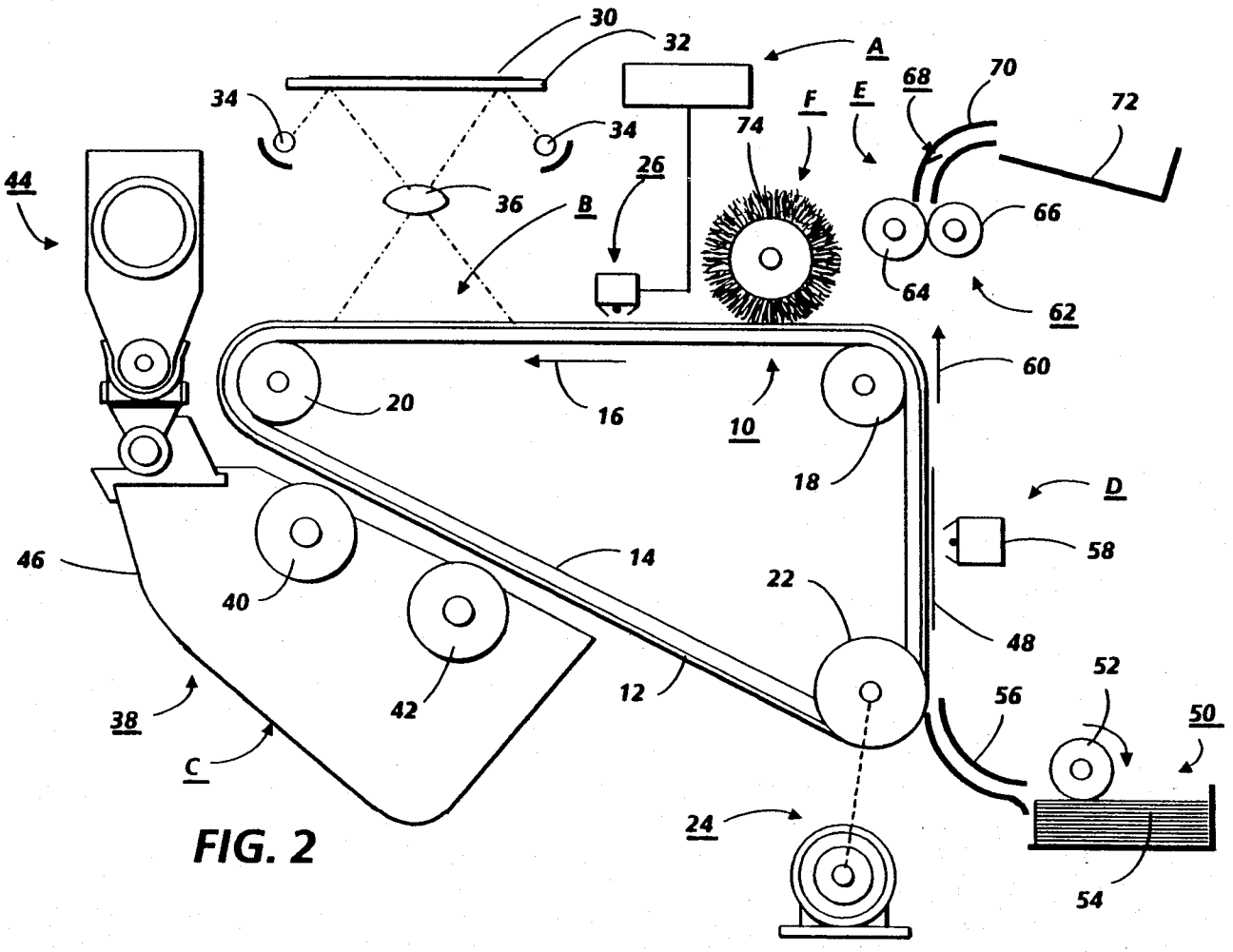
FIG. 2 is a schematic elevational view of an illustrative electrophotographic printing machine incorporating a fusing apparatus having the features of the present invention therein.

Referring now to FIG. 2, the electrophotographic printing machine employs a belt 10 having a photoconductive surface 12 deposited on a conductive substrate 14. Preferably, photoconductive surface 12 is made from a selenium alloy. Conductive substrate 14 is made preferably from an aluminum alloy which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges photoconductive surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30.

After the electrostatic latent image has been recorded on photoconductive surface 12, belt 10 advances the latent image to development station C. At development station C, a magnetic brush development system, indicated by the reference numeral 38, advances developer material into contact with the latent image. Preferably, magnetic brush development system 38 includes two magnetic brush developer rollers 40 and 42. Rollers 40 and 42 advance developer material into contact with the latent image. These developer rollers form a brush of carrier granules and toner particles extending outwardly therefrom. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, belt 10 advances the toner powder image to transfer station D. A copy sheet 48 is advanced to transfer station D by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image formed thereon contacts the advancing sheet at transfer station D. Transfer station D includes a corona generating device 58 which sprays ions onto the back side of sheet 62. This attracts the toner powder image from photoconductive surface 12 to sheet 48. After transfer, sheet 48 continues to move in the direction of arrow 60 onto a conveyor (not shown) which advances sheet 48 to fusing station E.

Fusing station E includes a fuser assembly, indicated generally by the reference numeral 62, which permanently affixes the transferred powder image to sheet 48. Fuser assembly 60 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 70. As sheet 48 advances through chute 70, a copy sheet sensor, indicated generally by the reference numeral 68, detects the presence or absence of the copy sheet in fusing apparatus 62 and indicates the status thereof to the control logic. By way of example, copy sheet sensor 68 may be a switch or a photosensor. The control logic counts the number of sheets passing through fusing apparatus 62. Chute 70 advances sheet 48 to catch tray 72 for subsequent removal from the printing machine by the operator. Further details of fusing apparatus 62 and the control system associated therewith will be described hereinafter with reference to FIGS. 3 through 5, inclusive.

After the copy sheet is separated from photoconductive surface 12 of belt 10, the residual toner particles adhering to photoconductive surface 12 are removed therefrom at cleaning station F. Cleaning station F includes a rotatably mounted fibrous brush 74 in contact with photoconductive surface 12. The particles are cleaned from photoconductive surface 12 by the rotation of brush 74 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 3:
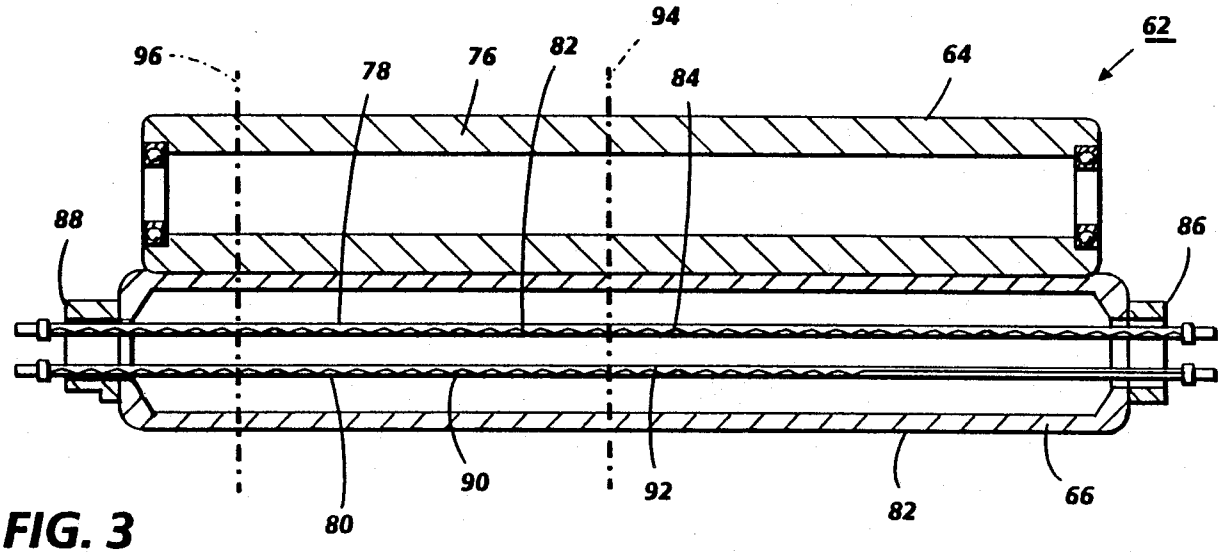
FIG. 3 is a side elevational view, partially in section, showing the fusing apparatus used in the FIG. 2 printing machine.

Referring now to FIG. 3, there is shown fusing apparatus 62 in greater detail. As shown thereat, fuser 62 includes a heated fuser roller 64 and a back-up roller 66. Fuser roller 64 is composed of a hollow tube 76 having a thin covering thereon. Heating elements 78 and 80 are disposed interiorly of tube 76. A thin layer of silicone oil is metered onto the fuser roller during fusing. Tube 76 is made from a metal material having the desired heat conductivity characteristics. By way of example, aluminum, copper and other metals having a high thermal conductivity are suitable for use as a tube. The thin layer coating tube 76 is made preferably from silicone rubber. Back-up roller 66 is mounted pivotable and is pressed against fuser roller 64. Back-up roller 66 has a relatively thick layer of silicone rubber on a metal tube 82. When fusing is occurring roller 66 pivots to press against roller 64. Back-up roller 66 and fuser roller 64 are adapted to rotate during the fusing operation so as to advance the copy sheet therethrough. Heating element 78 comprises a fuser lamp 82 having a filament 84 disposed interiorly thereof. As shown, fuser lamp 82 extends substantially along the longitudinal axis of fuser roller 64. Similarly, lamp filament 84 extends along the longitudinal axis of fuser lamp 82 disposed interiorly thereof. Filament 84 extends from one end 86 of fuser roller 64 to the other end 88 thereof. Heating element 80 comprises a fuser lamp 90 having a filament 92 disposed interiorly thereof. As shown, fuser lamp 90 extends substantially along the longitudinal axis of fuser roller 64. Similarly, lamp filament 92 extends along the longitudinal axis of fuser lamp 90 disposed interiorly thereof. Filament 92 extends from one end 88 of fuser roller 64 to a preselected location intermediate end 86 and reference axis 94. Fuser lamp 82 is designed to generate a greater energy output than fuser lamp 90. All copy sheets passing through fusing apparatus 62 are registered or aligned such that one edge thereof is substantially aligned with reference mark 96 on fuser roller 64. Thus, filament 84 extends a distance of about 16.5 inches from registration mark 96 with filament 92 extending a distance of about 14 inches from registration mark 96. Preferably registration mark 96 is about 0.3 inches from end 88 of fuser roller 64. By way of example, heating elements 78 and 80 may be halogen lamps having lamp filaments disposed interiorly thereof.

Figure 4:
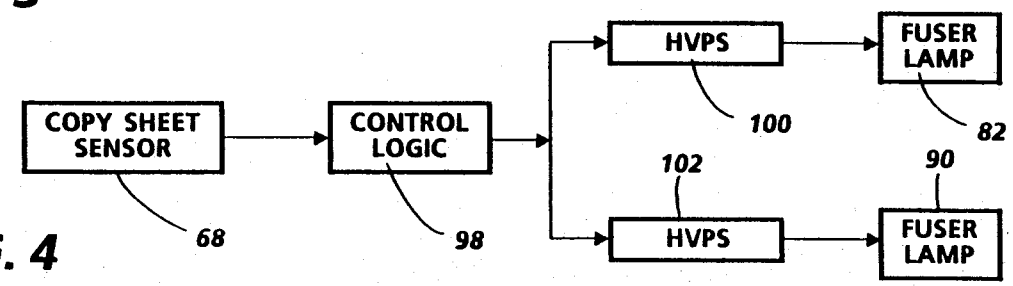
FIG. 4 is a block diagram illustrating the control system regulating the energy output of the FIG. 3 fusing apparatus.

Turning now to FIG. 4, copy sheet sensor 68 develops a voltage output signal which indicates the presence of a copy sheet. Copy sheet sensor 68 may be a conventional sheet path sensor, such as a photosensor of a switch, and is used for keeping track of the number of sheets that have passed through fusing apparatus 62. The voltage signal from sensor 68 is transmitted to control logic 98. Control logic 98 is preferably a programmable microprocessor which controls all the machine functions. In particular, the control logic 98 provides the storage and comparison of counts of the copy sheets and the number of copy sheets that have passed through the fusing apparatus. The decision whether or not to energize lamps 82 and 90 is made by control logic 98. The output from control logic 98 regulates the power output from high voltage power supply 100 and high voltage power supply 102. High voltage power supply 100 is coupled to fuser lamp 82 and, dependent upon the input thereto, regulates the heat output therefrom. High voltage power supply 102 is coupled to fuser lamp 90 and, dependent upon the input thereto, regulates the heat output therefrom. In the event the length of the copy sheet is less than 14 inches, lamp 90 is energized, and lamp 82 deenergized. Alternatively, if the length of the copy sheet is greater than 14 inches, the control scheme determines the energization of the appropriate fuser lamp. If the copy sheets being used have a length greater than 14 inches, fuser lamp 82 is energized and fuser lamp 90 deenergized for the first 100 copy sheets passing through fusing apparatus 62 as counted by the control logic. Thereafter, for the next 50 copies, fuser lamp 90 is energized and fuser lamp 82 deenergized. This cycle is repeated for every 150 copy sheets passing through fusing apparatus 62.

Figure 5:
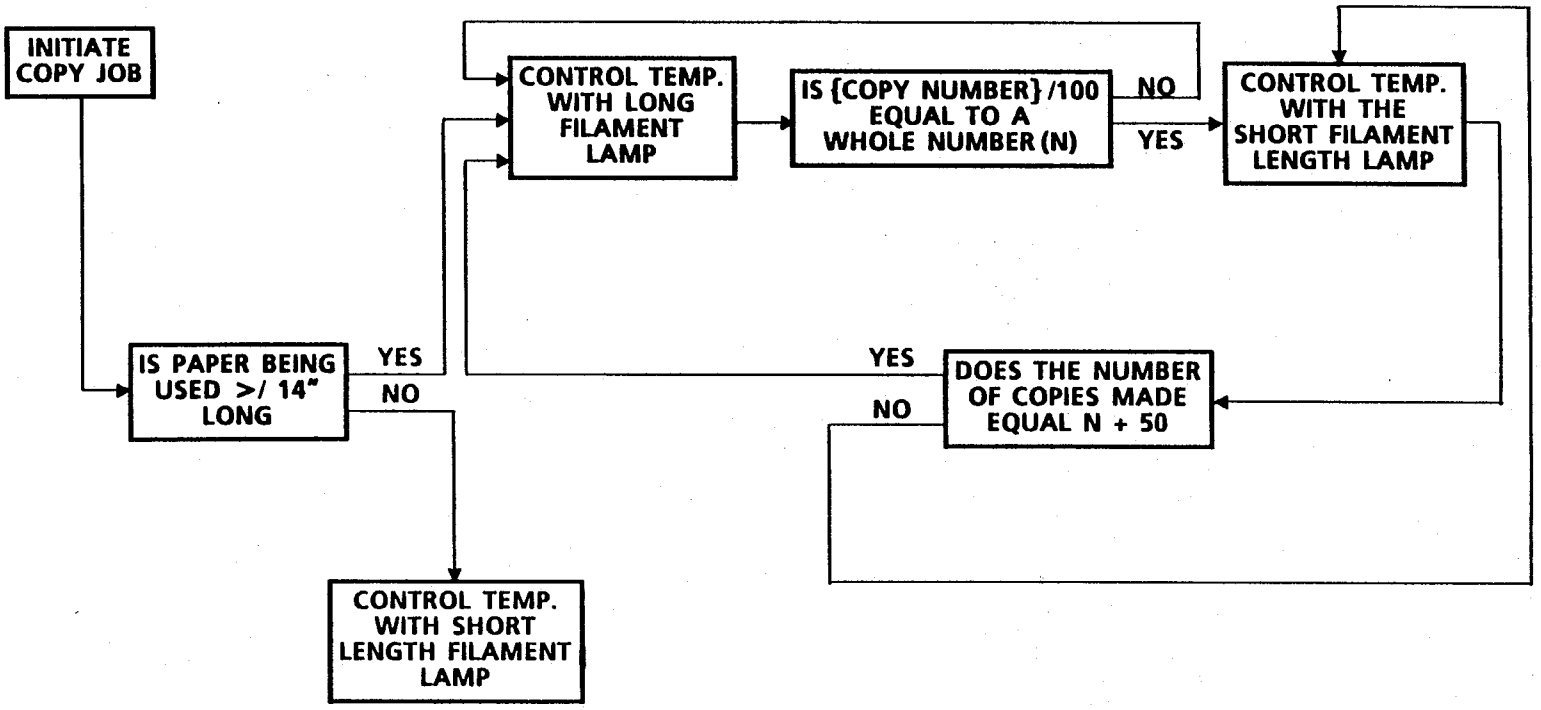
FIG. 5 is a flow diagram showing the control scheme used by the FIG. 4 control logic.

FIG. 5 more clearly depicts the flow diagram describing the operation of the control scheme. As shown thereat, the copy job is initiated. Sensors, such as photosensors or switches, associated with the tray supporting the stack of copy sheets 54 therein (FIG. 2) determine the size of the copy sheet and transmit a signal indicative thereof to control logic 98. Control logic 98 compares the signal from the sensors associated with the tray supporting the stack of sheets (FIG. 2) with a preselected constant corresponding to a copy sheet length of 14 inches. If the copy sheet length is less than 14 inches, fuser lamp 90 is energized and fuser lamp 82 is deenergized. Alternatively, if the length of the stack 54 of copy sheets is greater than 14 inches, fuser lamp 90 is deenergized and fuser lamp 82 is energized. Control logic 98 counts the number of of copy sheets passing through fusing apparatus 62. When the count equals 100 copy sheets, fuser lamp 82 is deenergized and fuser lamp 90 is energized. When the control logic counts another 50 copy sheets, the foregoing cycle is repeated.

Figure 6:
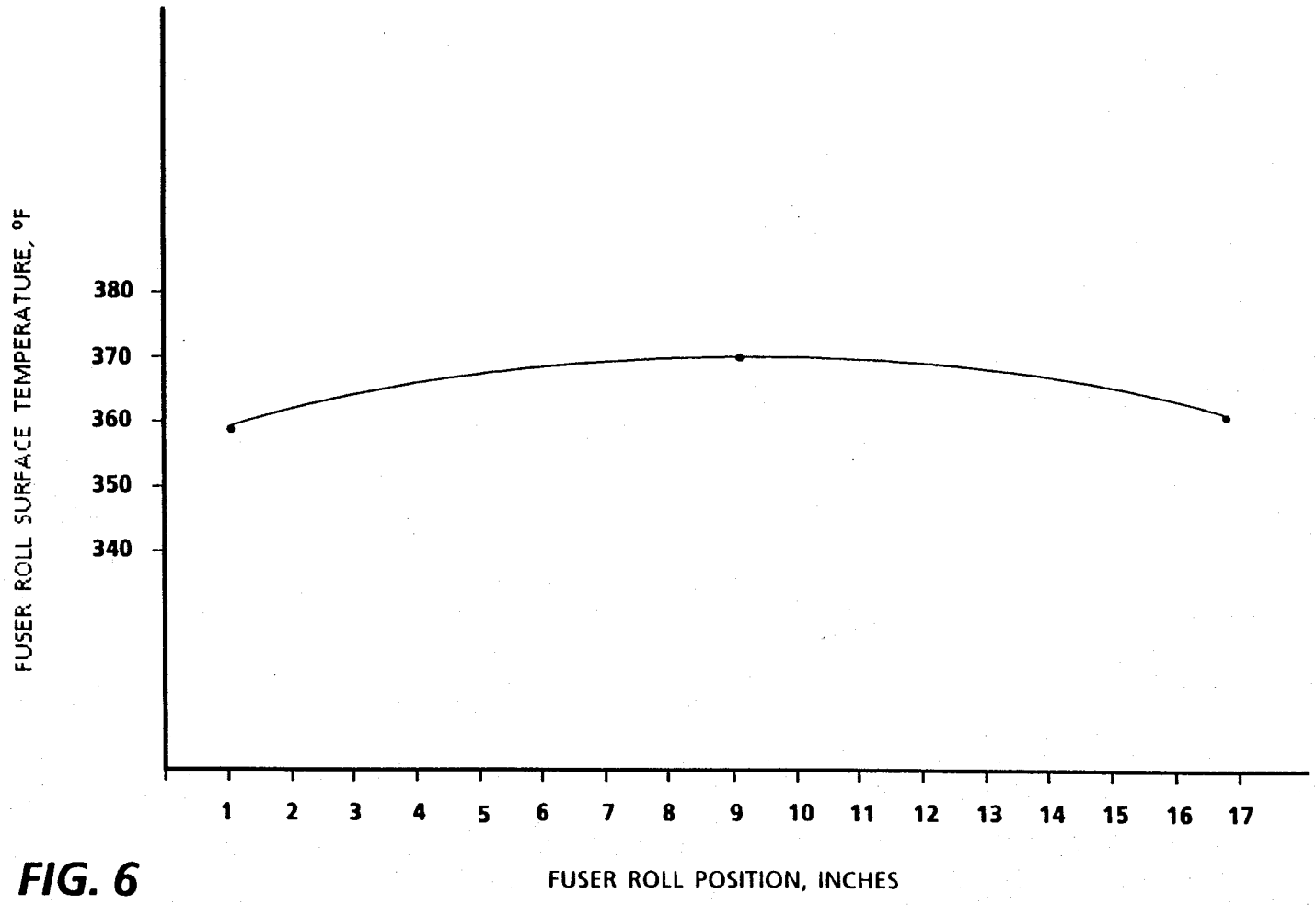
FIG. 6 is a graph showing the fuser roll surface temperature variaton along the length of the fuser roll when the FIG. 5 control scheme is employed.

Turning now to FIG. 6, there is shown the change in fuser roll temperature along its length when the control scheme of the present invention is used. As shown, no thermal hump is produced and the temperature profile remains substantially constant increasing from the ends there to the midpoint by about 10° F.

One skilled in the art will appreciate that while fusing of a dry toner powder image has been described, the control scheme of the present invention is also applicable to fusing a liquid image. Hence, the image being fused to the copy sheet may either be a liquid image or a dry powder image.

In recapitulation, it is evident that by controlling the energization of different length fusing lamps disposed interiorly of the fuser roller as a function of the number of copy sheets that have been fused and the size of the copy sheet, the temperature profile along the length of the fuser roller can be maintained substantially constant. In this manner, fusing is optimized for various size copy sheets.

It is, therefore, apparent that there has been provided in accordance with the present invention, a control system for a fusing apparatus of an electrophotographic printing machine that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications, and variations that fall within the spirit and broad scope of the appended claims.

I claim:

1. An apparatus for fusing an image to a sheet during a copy run, including:

means for counting the number of sheets having images fused thereto during the copy run;

means for applying heat to at least the images on successive sheets of the copy run; and means, responsive to the number of sheets counted by said counting means, for controlling said heat applying means.

2. An apparatus according to claim 1, wherein said heat applying means includes:

a fusing member adapted to contact at least the images on successive sheets of the copy run; and means, in communication with said counting means, for heating said fusing member.

3. An apparatus according to claim 2, wherein said heating means includes:

a first heating element disposed interiorly of said fusing member; and a second heating element disposed interiorly of said fusing element, said first heating element and said second heating element being arranged to extend across the sheet contacting said fusing member with said first heating element extending a greater distance than said second heating element.

4. An apparatus according to claim 3, wherein said first heating element generates greater heat than said second heating element.

5. An apparatus according to claim 4, further includes means for detecting the size of each of the sheets of the copy run.

6. An apparatus according to claim 5, wherein said controlling means regulates said heat applying means in responsive to the size of the sheet sensed by said detecting means.

7. An apparatus according to claim 6, wherein said controlling means deenergizes said first heating element in response to said detecting means sensing a sheet having a size less than a preselected size.

8. An apparatus according to claim 7, wherein said controlling means energizes said first heating element in response to said detecting means sensing a sheet having a size greater than the preselected size.

9. An apparatus according to claim 8, wherein size controlling means deenergizes said first heating element and energizes said second heating element in response to said counting means indicating that the number of sheets having images fused thereto during a copy run is greater than a first preselected number of sheets.

10. An apparatus according to claim 9, wherein said controlling means deenergizes said second heating element and energizes said first heating element in response to said counting means indicating that the number of sheets having images fused thereto during a copy run is greater than a second preselected number of sheets with the second preselected number of sheets being greater than the first preselected number of sheets.

11. An apparatus according to claim 10, wherein said fusing member is a fuser roll.

12. An apparatus according to claim 11, wherein:

said first heating element includes a first heating lamp positioned interiorly of said fuser roll extending in a direction substantially parallel to the longitudinal axis of said fuser roll from one end of said fuser roll to the other end thereof; and said second heating element includes a second heating lamp spaced from said first heating lamp and positioned interiorly of said fuser roll extending in a direction substantially parallel to the longitudinal axis of said fuser roll from one end of said fuser roll to the other end thereof.

13. An apparatus according to claim 12, further including a back-up roll engaging said fuser roll to define a nip through which the sheet with the image thereon passes.

14. An apparatus according to claim 13, wherein said first heating lamp includes a first heating filament disposed interiorly thereof and extending a distance substantially equal to the size of the largest sheet.

15. An apparatus according to claim 14, wherein said second heating lamp includes a first heating filament disposed interiorly thereof and extending a distance less than the distance that said first heating filament extends.

16. An electrophotographic printing machine of the type having a fusing apparatus for fusing an image transferred to a copy sheet during a copy run of the printing machine, wherein the improved fusing apparatus includes:

means for counting the number of copy sheets having images fused thereto during the copy run;

means for applying heat to at least the images on successive copy sheets of the copy run; and means, responsive to the number of copy sheets counted by said counting means, for controlling said heat applying means.

17. A printing machine according to claim 16, wherein said heat applying means includes:

a fusing member adapted to contact at least the images on successive copy sheets of the copy run; and means, in communication with said counting means, for heating said fusing member.

18. A printing machine according to claim 17, wherein said heating means includes:

a first heating element disposed interiorly of said fusing member; and a second heating element disposed interiorly of said fusing element, said first heating element and said second heating element being arranged to extend across the copy sheet contacting said fusing member with said first heating element extending a greater distance than said second heating element.

19. A printing machine according to claim 18, wherein said first heating element generates greater heat than said second heating element.

20. A printing machine according to claim 19, further including means for detecting the size of each of the copy sheets of the copy run.

21. A printing machine according to claim 20, wherein said controlling means regulates said heat applying means in responsive to the size of the copy sheet sensed by said detecting means.

22. A printing machine according to claim 21, wherein said controlling means deenergizes said first heating element in response to said detecting means sensing a copy sheet having a size less than a preselected size.

23. A printing machine according to claim 22, wherein said controlling means energizes said first heating element in response to said detecting means sensing a copy sheet having a size greater than the preselected size.

24. A printing machine according to claim 23, wherein said controlling means deenergizes said first heating element and energizes said second heating element in response to said counting means indicating that the number of copy sheets having images fused thereto during a copy run is greater than a first preselected number of copy sheets.

25. A printing machine according to claim 24, wherein said controlling means deenergizes said second heating element and energizes said first heating element in response to said counting means indicating that the number of copy sheets having images fused thereto during a copy run is greater than a second preselected number of copy sheets with the second preselected number of copy sheets being greater than the first preselected number of copy sheets.

26. A printing machine according to claim 24, wherein said fusing member is a fuser roll.

27. A printing machine according to claim 26, wherein:

said first heating element includes a first heating lamp positioned interiorly of said fuser roll extending in a direction substantially parallel to the longitudinal axis of said fuser roll from one end of said fuser roll to the other end thereof; and said second heating element includes a second heating lamp spaced from said first heating lamp and positioned interiorly of said fuser roll extending in a direction substantially parallel to the longitudinal axis of said fuser roll from one end of said fuser roll to the other end thereof.

28. A printing machine according to claim 27, further including a back-up roll engaging said fuser roll to define a nip through which the copy sheet with the toner powder image thereon passes.

29. A printing machine according to claim 28, wherein said first heating lamp includes a first heating filament disposed interiorly thereof and extending a distance substantially equal to the size of the largest copy sheet.

30. A printing machine according to claim 29, wherein said second heating lamp includes a first heating filament disposed interiorly thereof and extending a distance less than the distance that said first heating filament extends.

* * * * *